United States Patent [19]

Gray et al.

[11] 3,966,584

[45] June 29, 1976

[54] IMPROVEMENTS IN AND RELATING TO THE PRODUCTION OF COKE

[75] Inventors: Michael David Gray; Geoffrey Michael Kimber, both of Cheltenham, England

[73] Assignee: Coal Industry (Patents) Limited, London, England

[22] Filed: Nov. 22, 1974

[21] Appl. No.: 526,251

[30] Foreign Application Priority Data

Dec. 12, 1973 United Kingdom ..... 57608/73

[52] U.S. Cl. ..... 208/8; 208/46; 208/131

[51] Int. Cl.[2] ..... C10G 1/04

[58] Field of Search ..... 208/8

[56] References Cited

UNITED STATES PATENTS 3,375,188 3/1968 Bloomer ..... 208/8

3,503,864 3/1970 Nelson ..... 208/8

*Primary Examiner*—Herbert Levine

*Attorney, Agent, or Firm*—Stevens, Davis, Miller & Mosher

[57] ABSTRACT

A process for the production of coke which process comprises extracting coal at an elevated temperature with a suitable solvent, filtering undissolved material from the extract, concentrating the extract and thereafter coking the concentrated extract while recovering the solvent for re-circulation characterised in that prior to digestion of the coal the solvent is subjected to coking under conditions comparable with the conditions under which the coal solution is subjected to coking until coking of all the cokable components in the solvent is substantially complete.

9 Claims, No Drawings

IMPROVEMENTS IN AND RELATING TO THE PRODUCTION OF COKE

The present invention relates to the production of coke from coal and has particular reference to the production of substantially ash-free cokes from coal.

The production of coke from coal is generally well known and has hitherto been effected by extracting coal at an elevated temperature with a suitable solvent, filtering undissolved materials from the extract, concentrating the extract and thereafter coking the concentrated extract while recovering the solvent for recirculation.

This process has been found to operate satisfactorily, but where aliquots of fresh solvent are added to overcome losses during re-cycling and production generally, it has been found that the use of fresh solvent produces in the coking process a small quantity of coke which has a deleterious effect on the overall quality of the coke which would otherwise be obtained.

Although the recovery of solvent in such a process is substantially quantitative the character of the solvent is altered during the coking process. The "altered" solvent is suitable for the digestion and extraction of the coal and after it has been circulated once, the production of a deleterious coke is substantially reduced or eliminated.

It will be appreciated, therefore, that where virtually a complete batch of new solvent is employed, the coke initially produced is wholly unsatisfactory.

According to the present invention, there is provided a process of the kind described for the production of coke wherein prior to the digestion of the coal the solvent is subjected to coking under conditions, comparable with the conditions under which the coal solution is subjected to coking, until coking of all the cokable components in the solvent is substantially complete.

The solvent can then be repeatedly circulated through the coking apparatus under the conditions which the coal digests coke, without the substantial production of coke from the solvent itself. In other words, the solvent becomes refractory at the temperatures concerned. Typically, the pre-treatment of the solvent can be carried out at a temperature within the range 450°C. to 550°C. and at a pressure to prevent substantial boiling of the solvent.

Typical solvents are coal carbonization crude tar fractions such as "anthracene oil" which contains appreciable quantities of phenanthrene. Other polycyclic aromatic solvents obtained from petroleum catalytic and thermal cracking operations can also be used. However, the solvent most preferred is an anthracene oil containing substantial quantities of phenanthrene and especially alkylated, particularly methylated, phenanthrenes. A preferred boiling range for the solvent is within the range 180°C. to 400°C. and solvents having a middle 90% thereof boiling between 250°C. and 350°C. are preferred. In an alternative embodiment of the present invention, the solvent may be a distillate from an aromatic solvent feedstock which has been distilled at a temperature between 500°C. and 50°C. below the maximum temperature in the digestion stage and at a pressure of not less than 0.75 atmospheres whereby at least 5% of the solvent is not distilled. The present invention has particular reference to processes employing a delayed coking operation such as that described in our co-pending British application No. 55654/73.

Following is a description by way of example only of methods of carrying the invention into effect.

EXAMPLE 1

Coal from Beynon mine of 25% dmmf Vm 2.6% $O_2$ was digested for 1 hour at 400°C. with a fresh drained anthracene oil of boiling range 5–95% of 250°–390°C. with a "residue" of 3%. After filtering at 250°C. the solvent oil was distilled off under reduced pressure to an equivalent temperature of 400°C. at 1 bar. This was used in Example 2. The very concentrated solution thus produced which contained only 17% of the input oil was then coked at a final temperature of 500°C. This coke which contains 15% oil coke from the "residue" of the oil, was calcined at 1300°C. to give a real density of 2.11 $gcc^{-1}$ and then made into a graphite of CTE over the range 0°–100°C. of $10.5 \times 10^{-7}$ °$C^{-1}$.

EXAMPLE 2

Coal from Beynon mine of 25% dmmf Vm 2.6 $O_2$ was digested for 1 hour at 400°C. with the oil recovered from the filtrate in Example 1, which had a 5–95% boiling range of 270°–360°C. with less than 1% residue. After filtering at 250°C. the solvent oil was distilled off (see Example 1) and the solution coked at a final temperature of 500°C. This coke which contains no oil coke was calcined at 1300°C. to give a real density of 2.11 $gcc^{-1}$ and then made into a graphite of CTE over the range 0°–100°C. of $7.2 \times 10^{-7}$ °$C^{116\ 1}$.

EXAMPLE 3

Fresh drained anthracene oil was redistilled at atmospheric pressure to a temperature of 380°C. and the resulting pitch (~ 15% of original oil) coked in the same apparatus and conditions as Examples 1 and 2. The coke so produced was calcined at 1300°C. when the real density was measured at 2.00 $gcc^{-1}$, i.e. outside electrode coke specification of 2.06 $gcc^{-1}$; it was then made into a graphite which had a CTE 0°–100°C. of $49 \times 10^{-7}$ °$C^{-1}$.

EXAMPLE 4

Coal from Beynon mine of 25% dmmf Vm 3.0% $O_2$ was digested in a continuous reactor (average residence time 1½ hours) at 400°C. with refractorised anthracene oil, i.e. drained anthracene oil redistilled at atmospheric pressure, having a boiling range 5–95% of 240°–390°C. and a residue of about 1%. After filtering at 200°C. the solution was delay coked, i.e. preheated in less than 2 mins. to 500°C. and then injected into a coking drum preheated to 500°C. This coke was calcined at 1300°C. to give a real density of 2.1 $gcc^{-1}$ and then graphite of into a graphite of CTE over the range 0–100°C. of $7 \times 10^{-7}$ °$C^{-1}$.

EXAMPLE 5

Delay coking as in Example 4 of drained anthracene oil gave a coke which when calcined to 1300°C. had a real density of 2.00 $gcc^{-1}$ and the graphite made therefrom has a CTE of $47 \times 10^{-7}$ °$C^{-1}$.

From the foregoing examples, it will be noted that the use of refractorised or recirculated solvents gives rise to a coke having an acceptable density i.e. greater than 2.06 g/cc and a CTE over the range 0–100°C. of $9 \times 10^{-7}$ °$C^{-1}$ or less. Where fresh solvent or a proportion of fresh solvent is used then the CTE rises and the density decreases.

The analysis of the fresh and refractorised anthracene oils are as follows:-

| | Fresh | Recovered or Refractorised |
|---|---|---|
| C | 90.2 ± .2 | 90.7 ± .2 |
| H | 5.9 ± .1 | 5.9 ± .1 |
| N | 1.0 ± .1 | 1.0 ± .1 |
| S | 0.8 ± .1 | 0.8 ± .1 |
| O | 2.0 ± .2 | 1.5 ± .2 |

It will be noted that the coking of the high boiling fraction shows a significant reduction in oxygen (probably mainly phenols).

Fresh oils contain 2–8% of oil that cannot be distilled at atmospheric pressure which is due to the imperfect separation in a commerical tar distillation column. This residue produces poor coke of high CTE and some gases, and it is thus desirable to remove it from the solvent before use otherwise the overall coke quality will suffer and this is effected by the method of the invention.

In the foregoing examples, the anthracene oil, which is fractionally distilled from tar, is that fraction boiling between 280° and 350°C. (5–95%); after adding 10–20% of a lighter fraction of the tar (bp ~ 250°C) an anthracene rich paste is separated from it by centrifuging or filtering, and the resulting product is termed "Drained Anthracene Oil".

We claim:

1. A process for the production of coke which process comprises digesting coal at an elevated temperature with a solvent which includes non-recirculated solvent, filtering undissolved material from the extract, concentrating the extract and thereafter coking the concentrated extract while recovering the solvent for recirculation, characterized in that prior to use in the digestion of the coal, said non-recirculated solvent is subjected to coking under conditions comparable with the conditions under which the coal solution is subjected to coking until the coking of all the cokable components in the solvent under those conditions is substantially complete.

2. A process as claimed in claim 1 characterised in that the solvent is one or more of the crude tar fractions known as anthracene oil.

3. A process as claimed in claim 3 characterised in that the anthracene oil contains quantities of phenanthrene.

4. A process as claimed in claim 1 characterised in that the coal solvent includes polycyclic aromatic solvents obtained from petroleum catalytic and/or thermal cracking operations.

5. A process as claimed in claim 1 characterised in that the solvent includes an alkylated phenanthrene oil.

6. A process as claimed in claim 1 characterised in that the boiling range for the solvent is 150°C. to 400°C.

7. A process as claimed in claim 6 characterised in that the solvent has a middle 90% thereof boiling between 250°C. and 390°C.

8. A process as claimed in claim 1 characterized in that the prior coking of the solvent is carried out at a temperature within the range of 450°C. to 550°C. and at a pressure sufficient to prevent substantial boiling of the solvent.

9. A process as claimed in claim 1 characterized in that the solvent is a distillate of an aromatic solvent feedstock which distils at a temperature of between 500°C. and 50°C. below the maximum temperature in the digestion stage and at a pressure of not less than 0.75 atmospheres whereby as least 5% of the feedstock remains undistilled.

* * * * *